US011469548B2

(12) United States Patent
Yang et al.

(10) Patent No.: US 11,469,548 B2
(45) Date of Patent: Oct. 11, 2022

(54) CABLE CONNECTOR

(71) Applicant: AMPHENOL ASSEMBLETECH (XIAMEN) CO., LTD, Fujian (CN)

(72) Inventors: Wenchu Yang, Fujian (CN); Zhenxing Liu, Fujian (CN); Hui Tang, Fujian (CN); Hang Li, Fujian (CN); Luowen Lyu, Fujian (CN)

(73) Assignee: AMPHENOL ASSEMBLETECH (XIAMEN) CO., LTD, Xiamen (CN)

( * ) Notice: Subject to any disclaimer, the term of this patent is extended or adjusted under 35 U.S.C. 154(b) by 0 days.

(21) Appl. No.: 17/317,956

(22) Filed: May 12, 2021

(65) Prior Publication Data

US 2022/0255261 A1 Aug. 11, 2022

(30) Foreign Application Priority Data

Feb. 8, 2021 (CN) ..... 202120367899.6

(51) Int. Cl.

| | |
|---|---|
| ***H01R 13/627*** | (2006.01) |
| ***H01R 12/71*** | (2011.01) |
| ***H01R 13/502*** | (2006.01) |
| ***H01R 13/42*** | (2006.01) |
| ***H01R 12/75*** | (2011.01) |
| *H01R 13/629* | (2006.01) |

(52) U.S. Cl.

CPC ..... *H01R 13/6271* (2013.01); *H01R 12/716* (2013.01); *H01R 12/75* (2013.01); *H01R 13/42* (2013.01); *H01R 13/502* (2013.01); *H01R 13/629* (2013.01)

(58) Field of Classification Search

CPC .. H01R 13/6271; H01R 12/716; H01R 12/75; H01R 13/42; H01R 13/502; H01R 13/629

See application file for complete search history.

(56) References Cited

U.S. PATENT DOCUMENTS

| | | | | |
|---|---|---|---|---|
| 10,601,181 | B2 | 3/2020 | Lu et al. | |
| 2010/0273335 | A1* | 10/2010 | Wu | H01R 12/721 439/80 |
| 2019/0326710 | A1* | 10/2019 | Little | H01R 13/6582 |
| 2020/0076132 | A1* | 3/2020 | Yang | H01R 12/73 |
| 2020/0194932 | A1* | 6/2020 | Henry | H01R 13/629 |
| 2020/0203867 | A1* | 6/2020 | Lu | H01R 12/716 |
| 2020/0321727 | A1* | 10/2020 | Li | H01R 13/6275 |
| 2021/0075159 | A1* | 3/2021 | Wang | H01R 13/6582 |
| 2021/0408727 | A1* | 12/2021 | Fan | H01R 12/7005 |
| 2022/0029360 | A1* | 1/2022 | Little | H01R 13/65914 |

* cited by examiner

*Primary Examiner* — Abdullah A Riyami
*Assistant Examiner* — Nelson R. Burgos-Guntin

(57) ABSTRACT

A cable connector includes an insulator, an electrical connection portion, a cable and a latch, wherein the electrical connection portion is disposed in the insulator, and one end of the cable is electrically connected to the electrical connection portion; a front end of the insulator is provided with a projecting portion extending toward a bottom end of the insulator, the latch is disposed on the projecting portion, and a latch projection is disposed on a surface of the latch; a rear end of the insulator is provided with a first positioning post projecting toward the bottom end of the insulator; and the projecting portion and the first positioning post of the cable connector are respectively cooperated with a docking connector. The cable connector can implement forward and reverse plug of the cable connector; thereby facilitating wiring of the customer on the mainboard.

11 Claims, 2 Drawing Sheets

CABLE CONNECTOR

CROSS REFERENCE TO RELATED APPLICATIONS

The present application claims the benefit of Chinese Patent Application No. 202120367899.6 filed on Feb. 8, 2021, the contents of which are incorporated herein by reference in their entirety.

TECHNICAL FIELD

The disclosure belongs to the technical field of connectors, and more particularly relates to a cable connector.

BACKGROUND

When existing connectors are plugged in, the board connector typically has only one insertion direction when mating with the cable connector. When the board connector is placed onto a mainboard, the direction of the cable connector typically also has the corresponding insertion direction; and when the cable connector is reversely disposed on the mainboard at 180°, the direction of the board connector typically also needs to rotate 180°, so as to mate with the corresponding insertion direction. In order to keep PIN positions of the board connector consistent, all connectors are arranged in the same direction. In actual applications, there is a requirement that cables outgo to two sides. When the cable outgoing direction of the cable required by the rightmost connector is rightward, this application is often accomplished by bending the cables. Such a cable bending manner has an impact on the performance of the cables, increases the mating height of the product and makes an elastic sheet difficult to be pressed, and thus it is very difficult to pull out the cable; and when the rightmost connector rotates 180° for placement, the definition of the PIN of the connector is different from other connectors to make the system wiring complicated.

Therefore, there is a need for a cable connector that can implement bidirectional blind insertion and can be plugged in the board connector in forward and reverse directions.

SUMMARY

An objective of the present disclosure is to provide a cable connector that can implement bidirectional blind plug of the connector.

To achieve the above-mentioned objective, the disclosure provides a cable connector, which includes an insulator, an electrical connection portion, a cable and a latch, wherein the electrical connection portion is disposed in the insulator, and one end of the cable is electrically connected to the electrical connection portion;

a front end of the insulator is provided with a projecting portion extending toward a bottom end of the insulator, the latch is disposed on the projecting portion, and a latch projection is disposed on a surface of the latch;

a rear end of the insulator is provided with a first positioning post projecting toward the bottom end of the insulator;

wherein, the projecting portion and the first positioning post of the cable connector are used to respectively cooperated with a docking connector.

Preferably, both the first positioning post and the projecting portion are of a flat-plate shape, and the first positioning post is parallel to the projecting portion.

Preferably, the front end of the insulator is provided with a second positioning post projecting toward the bottom end of the insulator, and the second positioning post is positioned at a side of the projecting portion and can be inserted into a positioning slot of the docking connector.

Preferably, a pair of the second positioning posts are provided, and the pair of the second positioning posts are respectively positioned at two sides of the projecting portion.

Preferably, a width of the first positioning post is more than a width of the projecting portion.

Preferably, the rear end of the insulator is provided with a second positioning post projecting toward the bottom end of the insulator, and the second positioning post is positioned at a side of the first positioning post.

Preferably, a pair of the second positioning posts are provided, and the pair of the second positioning posts are respectively positioned at two sides of the first positioning post and can be inserted into a positioning slot of the docking connector.

Preferably, a width of the projecting portion is more than a width of the first positioning post.

Preferably, the insulator includes a docking portion for docking with the docking connector, the electrical connection portion is disposed in the docking portion, and the docking portion is disposed between the projecting portion and the second positioning post.

Preferably, a first gap is formed between the docking portion and the projecting portion, a second gap is formed between the docking portion and the first positioning post, and the first gap and the second gap are respectively used for insertion with the docking connector during docking.

Preferably, the cable connector further includes a pull tab connected to the latch.

The cable connector of the disclosure has the following beneficial effects: the cable connector is respectively cooperated with the board connector through the projecting portion and the first positioning post to implement forward and reverse plug of the cable connector; and thus, forward and reverse plug directions of the cable connector can be determined according to an actual need without changing the direction of the board connector, and pins of the board connector may be arranged in the same sequence, thereby facilitating wiring of the customer on the mainboard.

Other features and advantages of the disclosure will be described in detail in the following detailed description.

BRIEF DESCRIPTION OF THE DRAWINGS

More detailed descriptions are made to the exemplary embodiments of the disclosure in combination with the accompanying drawings. The above and other objectives, features and advantages of the disclosure will become more apparent. In the exemplary embodiments of the disclosure, the same reference signs typically represent the same components.

REFERENCES

Figure 1:
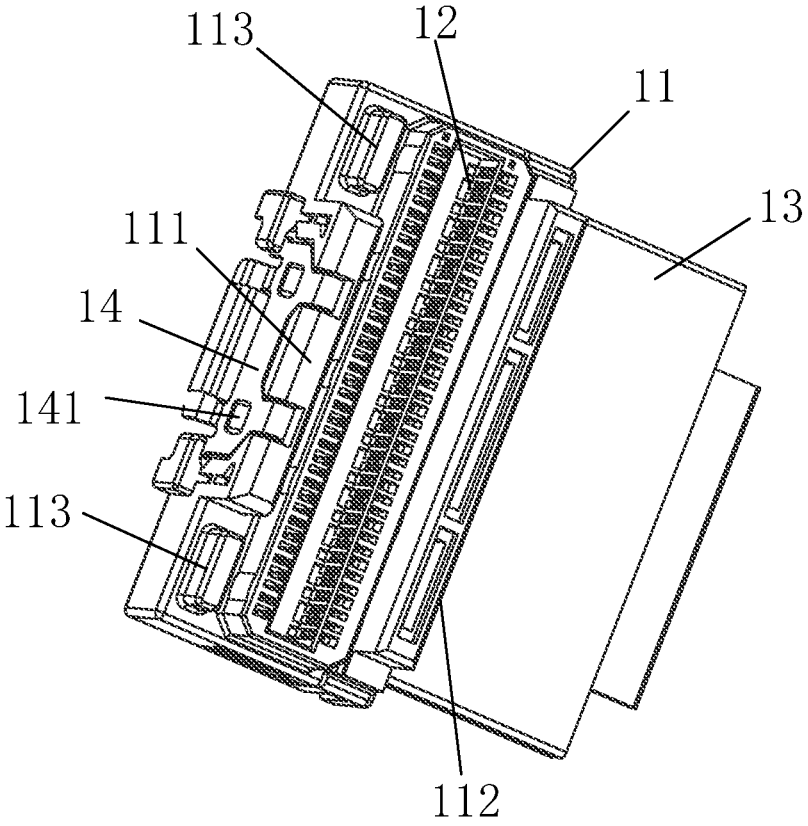
FIG. 1 illustrates a structural schematic diagram of a cable connector according to an exemplary embodiment of the disclosure.

11 insulator, 111 projecting portion, 112 first positioning post, 113 second positioning post, 12 electrical connection portion, 13 cable, 14 latch, 141 latch projection, 21 board insulator, 22 board electrical connection portion, 23 board housing, 231 plugging slot, 232 lock hole, and 233 positioning slot.

DESCRIPTION OF THE EMBODIMENTS

Preferred embodiments of the disclosure will be described below in more detail. Although the preferred embodiments of disclosure are described below, it should be understood that the disclosure may be implemented in various forms and should not be limited by the embodiments illustrated herein. On the contrary, these embodiments are provided to make the disclosure more thorough and complete, and convey the scope of the disclosure to those skilled in the art completely.

In the description of the disclosure, it is to be understood that the orientations or positional relationships indicated by terms "central", "longitudinal", "transverse", "length", "width", "thickness", "upper", "lower", "front", "rear", "left", "right", "vertical", "horizontal", "top", "bottom", "inner", "outer", "clockwise", "anti-clockwise", "axial", "radial", "peripheral" and the like are the orientations or positional relationships shown based on the accompanying drawings, which is merely for the purposes of describing the disclosure and simplifying the description, rather than indicating or implying the indicated apparatus or element must have the special orientation and be constructed and operated in the special orientation. Thus, these terms cannot be understood as limits to the disclosure.

In order to solve the problems in the prior art, the disclosure provides a cable connector, which includes an insulator, an electrical connection portion, a cable and a latch; and the electrical connection portion is disposed in the insulator, and one end of the cable is electrically connected to the electrical connection portion.

A front end of the insulator is provided with a projecting portion extending toward a bottom end of the insulator, the latch is disposed on the projecting portion, and a latch projection is disposed on a surface of the latch.

A rear end of the insulator is provided with a first positioning post projecting toward the bottom end of the insulator.

The projecting portion and the first positioning post of the cable connector are respectively cooperated with a docking connector.

The cable connector related by the disclosure is respectively cooperated with the board connector through the projecting portion and the first positioning post to implement forward and reverse plugging of the cable connector; and thus, forward and reverse plugging directions of the cable connector can be determined according to an actual need without changing the direction of the board connector, and pins of the board connector may be arranged in the same sequence, thereby facilitating wiring of the customer on the mainboard.

Preferably, both the first positioning post and the projecting portion are of a flat-plate shape, and the first positioning post is parallel to the projecting portion.

The first positioning post and the projecting portion may be parallel to each other and may also not be parallel to each other, which is determined according to an actual need.

Preferably, the electrical connection portion is a terminal or a circuit board.

The docking connector is the board connector and includes a board insulator, a board electrical connection portion and a board housing; and the board electrical connection portion is disposed in the board insulator, and the board housing sleeves the board insulator and is inserted to an upper end surface of a product mainboard. A lock hole is respectively provided on a pair of opposite end surfaces of the board housing, a plugging slot is formed between each end surface and the board insulator, and when the cable connector is plugged in the board connector, the electrical connection portion is electrically connected to the board electrical connection portion, the latch projection is clamped into the lock hole, and the projecting portion and the first positioning post are respectively and cooperatively connected to one plugging slot.

Preferably, a positioning slot is provided outside one end of the board insulator, and the positioning slot is positioned at one side of the plugging slot.

Preferably, a pair of the positioning slots are provided, the pair of the positioning slots are respectively positioned at two sides of the plugging slot and near a side of the board housing, and a wall of the positioning slot is attached to an inner wall of the end surface.

Preferably, thicknesses of the projecting portion and the first positioning post may be the same and may also be different, which is determined according to an actual use need.

Preferably, the front end of the insulator is provided with a second positioning post projecting toward the bottom end of the insulator, and the second positioning post is positioned at a side of the projecting portion and can be inserted into a positioning slot of the docking connector.

Preferably, a pair of the second positioning posts are provided, and the pair of the second positioning posts are respectively positioned at two sides of the projecting portion.

Preferably, a width of the first positioning post is more than a width of the projecting portion.

The second positioning post is cooperated with the positioning slot of the docking connector for the fear of reverse insertion. When the second positioning post is positioned at the side of the projecting portion, the width of the projecting portion is less than the width of the first positioning post for the fear of reverse insertion of the cable connector.

Preferably, the rear end of the insulator is provided with a second positioning post projecting toward the bottom end of the insulator, and the second positioning post is positioned at a side of the first positioning post.

Preferably, a pair of the second positioning posts are provided, and the pair of the second positioning posts are respectively positioned at two sides of the first positioning post and can be inserted into a positioning slot of the docking connector.

Preferably, a width of the projecting portion is more than a width of the first positioning post.

The second positioning post is cooperated with the positioning slot of the docking connector for the fear of reverse insertion. When the second positioning post is positioned at the side of the first positioning post, the width of the first positioning post is less than the width of the projecting portion for the fear of reverse insertion of the cable connector.

Preferably, the second positioning post is a rectangle.

Preferably, the insulator includes a docking portion for docking with the docking connector, the electrical connection portion is disposed in the docking portion, and the docking portion is disposed between the projecting portion and the second positioning post.

Preferably, a first gap is formed between the docking portion and the projecting portion, a second gap is formed between the docking portion and the first positioning post, and the first gap and the second gap are respectively used for insertion with the docking connector during docking and configured to accommodate an insulator of the docking connector.

Preferably, the cable connector further includes a pull tab, connected to the latch, and configured to pull the latch such that the latch projection is separated from the lock hole for unlocking.

Embodiment 1

Figure 2:
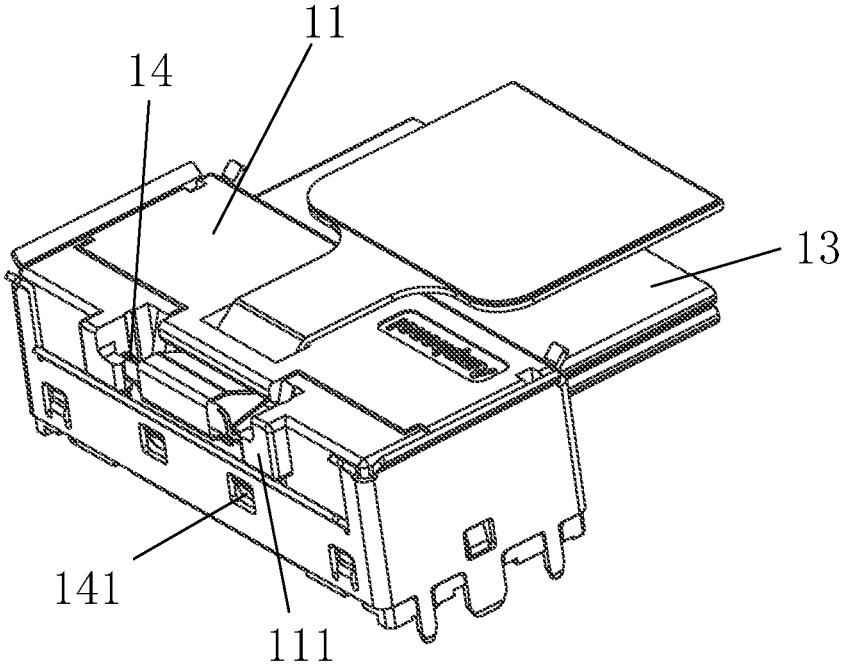
FIG. 2 illustrates an application schematic diagram of a cable connector according to an exemplary embodiment of the disclosure.
Figure 3:
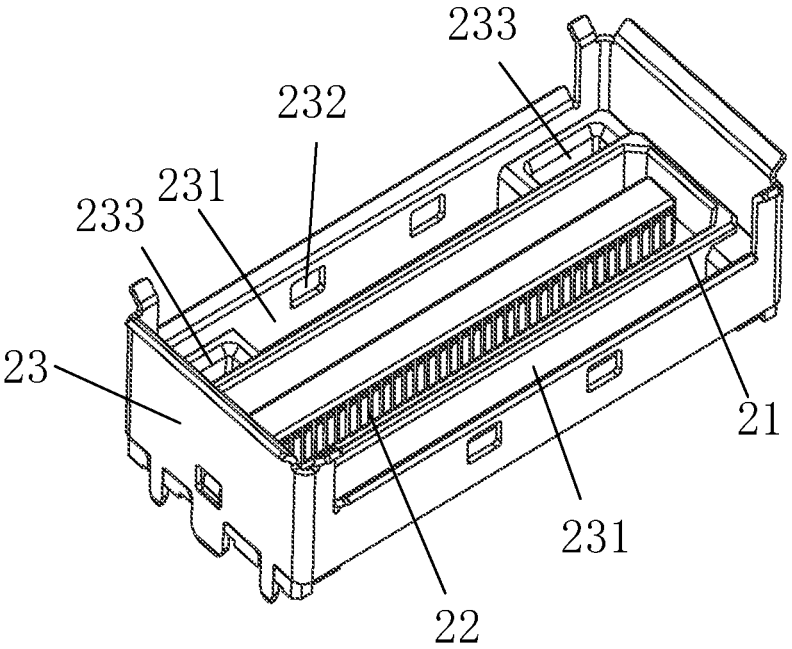
FIG. 3 illustrates a structural schematic diagram of a docking connector cooperatively used with a cable connector according to an exemplary embodiment of the disclosure.

As shown in FIG. 1 to FIG. 3, the disclosure provides a cable connector, which includes an insulator 11, an electrical connection portion 12, a cable 13 and a latch 14; the electrical connection portion 12 is disposed in the insulator 11, and one end of the cable 13 is electrically connected to the electrical connection portion 12; a front end of the insulator 11 is provided with a projecting portion 111 extending toward a bottom end of the insulator 11, the latch 14 is disposed on the projecting portion 111, and a latch projection 141 is disposed on a surface of the latch 14; and a rear end of the insulator 11 is provided with a first positioning post 112 projecting toward the bottom end of the insulator 11.

The projecting portion 111 and the first positioning post 112 of the cable connector are respectively cooperated with a docking connector.

In the embodiment, both the first positioning post 112 and the projecting portion 111 are of a flat-plate shape, and the first positioning post is parallel to the projecting portion. The electrical connection portion 12 is a terminal.

The docking connector is the board connector and includes a board insulator 21, a board electrical connection portion 22 and a board housing 23; and the board electrical connection portion 22 is disposed in the board insulator 21, and the board housing 23 sleeves the board insulator 21 and is inserted to an upper end surface of a product mainboard. A lock hole 232 is respectively provided on a pair of opposite end surfaces of the board housing 23, and a plugging slot 231 is formed between each end surface and the board insulator. When the cable connector is plugged in the board connector, the electrical connection portion 12 is electrically connected to the board electrical connection portion 22, the latch projection 141 is clamped into the lock hole 232, and the projecting portion 111 and the first positioning post 112 are respectively and cooperatively connected to one plugging slot 231.

In the embodiment, the front end of the insulator 11 is provided with a second positioning post 113 projecting toward the bottom end of the insulator 11, and the second positioning post 113 is positioned at a side of the projecting portion 111 and can be plugged in a positioning slot of the docking connector. A pair of the second positioning posts 113 are provided, and the pair of the second positioning posts 113 are respectively positioned at two sides of the projecting portion 111. A width of the first positioning post 112 is more than a width of the projecting portion 111.

The second positioning post 113 is cooperated with the positioning slot 233 of the docking connector for the fear of reverse insertion. When the second positioning post 113 is positioned at the side of the projecting portion 111, the width of the projecting portion 111 is less than the width of the first positioning post 112 for the fear of reverse insertion of the cable connector.

The second positioning post 113 is a rectangle.

The insulator 11 includes a docking portion for docking with the docking connector, the electrical connection portion 12 is disposed in the docking portion, and the docking portion is disposed between the projecting portion 111 and the second positioning post 113. A first gap is formed between the docking portion and the projecting portion 111, a second gap is formed between the docking portion and the first positioning post 112, and the first gap and the second gap are respectively used for insertion with the docking connector during docking and configured to accommodate an insulator 11 of the docking connector.

In the embodiment, the cable connector further includes a pull tab, connected to the latch 14, and configured to pull the latch 14 such that the latch projection 141 is separated from the lock hole for unlocking.

Embodiment 2

Figure 4:
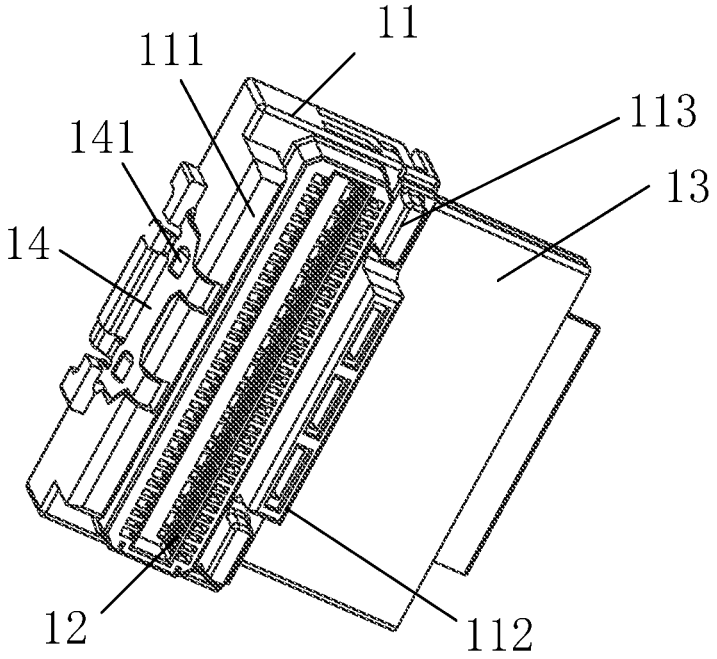
FIG. 4 illustrates a structural schematic diagram of a cable connector according to another exemplary embodiment of the disclosure.

As shown in FIG. 4, the differences of the cable connector in Embodiment 2 from Embodiment 1 lie in:

In the embodiment, the rear end of the insulator 11 is provided with a second positioning post 113 projecting toward the bottom end of the insulator 11, and the second positioning post 113 is positioned at a side of the first positioning post 112. A pair of the second positioning posts 113 are provided, and the pair of the second positioning posts 113 are respectively positioned at two sides of the first positioning post 112 and can be inserted into a positioning slot 233 of the docking connector. A width of the projecting portion 111 is more than a width of the first positioning post 112.

The second positioning post 113 is cooperated with the positioning slot 233 of the docking connector for the fear of reverse insertion. When the second positioning post 113 is positioned at the side of the first positioning post 112, the width of the first positioning post 112 is less than the width of the projecting portion 111 for the fear of reverse plugging of the cable connector.

The above has described various embodiments of the disclosure. The above descriptions are exemplary rather than exhaustive, and are not limited to the disclosed embodiments. Numerous modifications and changes will be apparent to those of ordinary skill in the art without departing from the scope and spirit of the illustrated embodiments.

What is claimed is:

1. A cable connector, comprising an insulator (11), an electrical connection portion (12), a cable (13) and a latch (14), wherein the electrical connection portion (12) is disposed in the insulator (11), and one end of the cable (13) is electrically connected to the electrical connection portion (12);

a front end of the insulator (11) is provided with a projecting portion (111) extending toward a bottom end of the insulator (11), the latch (14) is disposed on the projecting portion (111), and a latch projection (141) is disposed on a surface of the latch (14);

a rear end of the insulator (11) is provided with a first positioning post (112) projecting toward the bottom end of the insulator (11);

wherein, the projecting portion (111) and the first positioning post (112) of the cable connector are used to respectively cooperate with a docking connector;

the front end or rear end of the insulator (11) is provided with a second positioning post (113) projecting toward the bottom end of the insulator (11), and the second positioning post (113) can be inserted into a positioning slot of the docking connector.

2. The cable connector according to claim 1, wherein both the first positioning post (112) and the projecting portion (111) are of a flat-plate shape, and the first positioning post (112) is parallel to the projecting portion (111).

3. The cable connector according to claim 1, wherein the second positioning post (113) is positioned at a side of the projecting portion (111).

4. The cable connector according to claim 3, wherein a pair of the second positioning posts (113) are provided, and the pair of the second positioning posts (113) are respectively positioned at two sides of the projecting portion (111).

5. The cable connector according to claim 4, wherein a width of the first positioning post (112) is more than a width of the projecting portion (111).

6. The cable connector according to claim 1, wherein the second positioning post (113) is positioned at a side of the first positioning post (112).

7. The cable connector according to claim 6, wherein a pair of the second positioning posts (113) are provided, and the pair of the second positioning posts (113) are respectively positioned at two sides of the first positioning post (112).

8. The cable connector according to claim 6, wherein a width of the projecting portion (111) is more than a width of the first positioning post (112).

9. The cable connector according to claim 1, wherein the insulator (11) comprises a docking portion for docking with the docking connector, the electrical connection portion (12) is disposed in the docking portion, and the docking portion is disposed between the projecting portion (111) and the second positioning post (113).

10. The cable connector according to claim 9, wherein a first gap is formed between the docking portion and the projecting portion (111), a second gap is formed between the docking portion and the first positioning post (112), and the first gap and the second gap are respectively used for insertion with the docking connector during docking.

11. The cable connector according to claim 1, further comprising a pull tab connected to the latch (14).

* * * * *